United States Patent [19]

Miller et al.

[11] 4,106,742

[45] Aug. 15, 1978

[54] DECORATIVE PLATE MOUNTING ASSEMBLY

[76] Inventors: Emil E. Miller; Stella Maye Miller, both of 1652 Brown St., Dayton, Ohio 45409

[21] Appl. No.: 759,391

[22] Filed: Jan. 14, 1977

[51] Int. Cl.[2] ..... A47G 1/24

[52] U.S. Cl. ..... 248/488; 248/226.5; 248/316 R; 248/491

[58] Field of Search ..... 248/466, 510, 468, 488, 248/490, 491, 27.1, 27.3, 442, 450, 226.5, 226.1, 231.1, 231, 305, 310, 316 R, 316 A; 40/156; 206/18, 82; 269/254 CS, 287; 428/13, 14; 24/3 L, 73 HL, 263 SB

[56] References Cited

U.S. PATENT DOCUMENTS

| | | | |
|---|---|---|---|
| 2,483,724 | 10/1949 | Butler | 248/226.5 X |
| 2,488,147 | 11/1949 | Theisen | 248/491 |
| 2,488,243 | 11/1949 | Schneir | 248/491 |
| 2,598,610 | 5/1952 | Satz et al. | 269/254 CS |
| 2,826,384 | 3/1958 | Brown | 248/491 |
| 2,899,154 | 8/1959 | Zavalner | 248/316 R X |
| 3,674,913 | 7/1972 | Yates | 248/27.1 X |
| 3,740,016 | 6/1973 | Buescher | 248/488 |
| 3,801,996 | 4/1974 | Busch | 248/27.1 X |

*Primary Examiner*—Rodney H. Bonck
*Attorney, Agent, or Firm*—Jacox & Meckstroth

[57] ABSTRACT

A decorative plate mounting assembly which includes a mounting panel or the like and means for securing a plate to the mounting panel. The mounting panel may, if desired, be framed.

4 Claims, 5 Drawing Figures

FIG-1
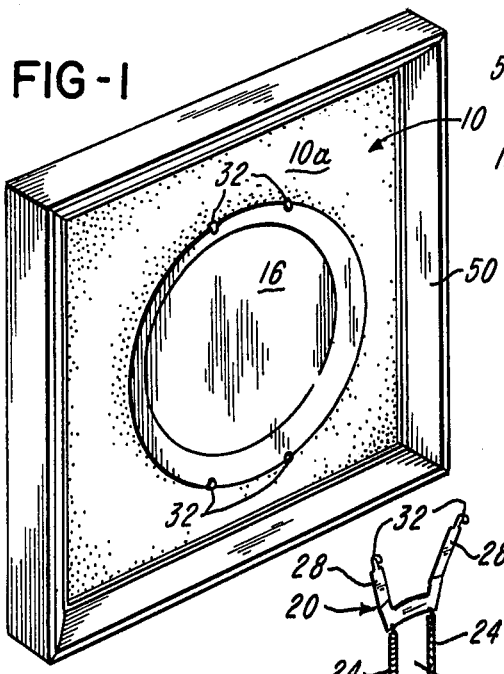
FIG-2
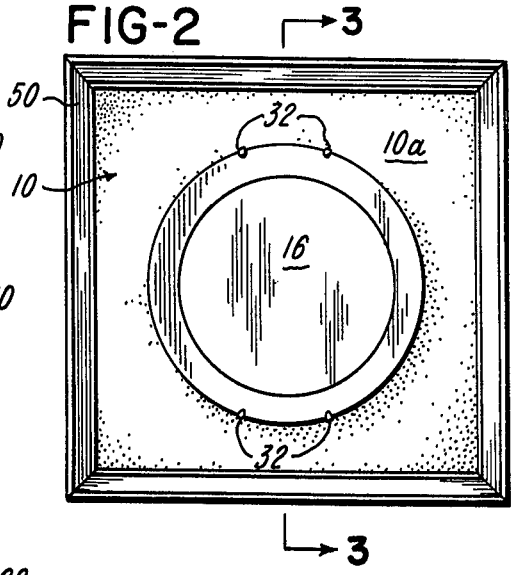
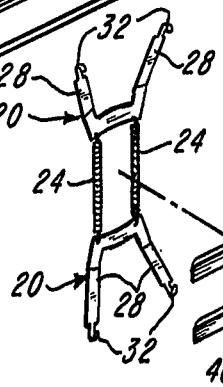
FIG-3
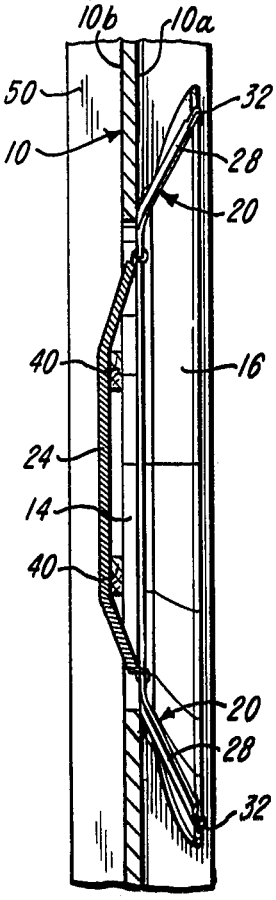
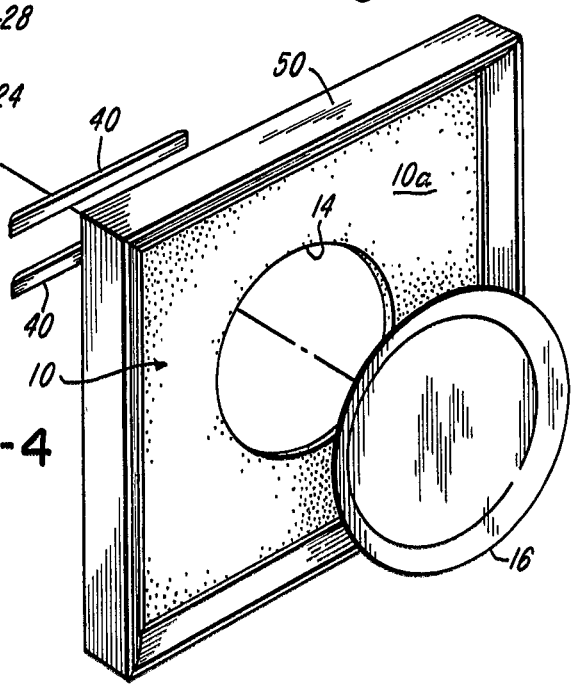
FIG-4
FIG-5
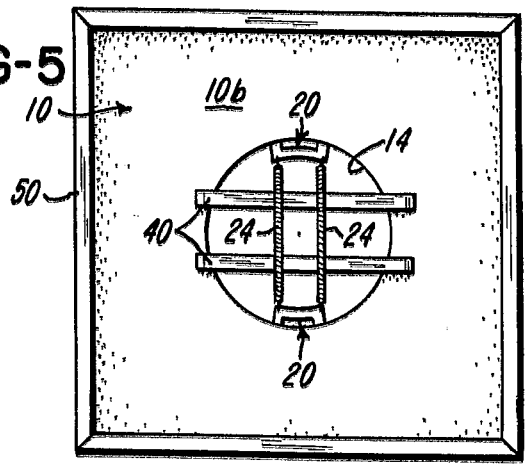

DECORATIVE PLATE MOUNTING ASSEMBLY

BACKGROUND OF THE INVENTION

An item such as a plate or the like may be decorative, and it is sometimes desired to have means for display of the plate or such item upon a wall.

It is an object of this invention to provide support structure for retaining and/or for display of objects such as a decorative plate, plaque, an article of silverware or a piece of sculpture or the like.

It is another object of this invention to provide such support structure by which such an item can be easily, and readily, and attractively displayed upon a wall.

Another object of this invention is to provide such support structure which will accomodate plates or the like of various sizes and shapes.

Another object of this invention is to provide such support structure for a plate or the like from which such plate or the like cannot be removed without removing the support structure from the wall.

Another object of this invention is to provide such support structure for display of a plate or the like in which it is not necessary to employ screws, nails, or the like for securing the plate to the support structure.

Another object of this invention is to provide such support structure in which minimum area of the plate is engaged by the support means and in which there is no engagement element which may damage the plate.

Other objects and advantages of this invention reside in the construction of parts, the combination thereof, the method of manufacture, and the mode of operation, as will become more apparent from the following description.

SUMMARY OF THE INVENTION

The decorative plate mounting assembly of this invention comprises a panel provided with an opening therein, the panel has a front surface and a rear surface, the front surface is adapted to receive a plate in front of the opening, the plate has a front side and a rear side, holder means are positioned at the rear side of the plate having portions which engage the front side of the plate at the edge thereof, spring means are attached to the holder means and urge the holder means to grasp the edges of the plate, a rigid member is positioned at the rear side of the plate between the plate and the spring means and extends across the opening at the rear side of the panel, the rigid member engages the rear side of the panel adjacent the opening, and secures the spring means and the holder means to the panel, thus securing the plate to the panel.

BRIEF DESCRIPTION OF THE VIEWS OF THE DRAWING

FIG. 1 is a perspective view of the front side of a mounting assembly of this invention and the front side of a plate supported thereby.

FIG. 2 is a front view of the mounting assembly shown in FIG. 1.

FIG. 3 is an enlarged sectional view, taken substantially on line 3—3 of FIG. 2.

FIG. 4 is an exploded front perspective view of the mounting assembly of FIGS. 1, 2, and 3 and the plate supported thereby.

FIG. 5 is a back view of the mounting assembly of FIGS. 1–4, showing the plate supported thereby.

DESCRIPTION OF THE PREFERRED EMBODIMENT

A mounting assembly of this invention for display of an object such as a plate or the like comprises a panel 10 of any suitable dimensions and of any suitable shape. The panel 10 has a front surface 10*a* and a rear surface 10*b*. The panel 10 has an opening 14 therethrough, shown herein as being at substantially the center thereof. The opening 14 may be any suitable size and shape. A display object, such as a decorative plate or similar article or the like, such as a decorative plate 16 may be positioned at the front surface 10*a* of the panel 10, substantially concentric with the opening 14.

Yokes 20 are attached together by spring members 24 at the rear side of the plate 16. Each of the yokes 20 has a pair of stems 28. Each stem 28 has a curved finger 32 at the end thereof. The fingers 32 extend around the edges of the plate 16 and grasp edges of the plate 16 at spaced-apart portions thereof. The spring members 24 urge the yokes 20 one toward the other and thus retain the fingers 32 in firm gripping relationship to the edges of the plate 16. One or more rigid cross members 40 are positioned at the rear surface 10*b* of the panel 10 and are positioned between the spring members 24 and the rear side of the plate 16. The cross members 40 extend across the opening 14 and engage the rear surface 10*b* of the panel 10. Thus, the plate 16 is firmly retained in desired position with respect to the panel 10. If desired, the opposed ends of each rigid cross member 40 may be attached to the rear surface of the panel 10.

The panel 10 is shown as having a frame 50 at the periphery thereof, which may be a part of the mounting assembly if desired. Any suitable means may be used to attach or hang the mounting assembly upon a wall or other desired support structure.

It is thus to be understood that the mounting assembly of this invention may be employed to display a decorative plate or other item. When the mounting assembly is hanging from a wall or the like it is necessary to remove the mounting assembly from the wall in order to remove the decorative plate 16 from the mounting assembly. Thus, theft of the decorative plate is minimized.

Although the preferred embodiment of the decorative plate mounting assembly of this invention has been described, it will be understood that within the purview of this invention various changes may be made in the form, details, proportion and arrangement of parts, the combination thereof, and the mode of operation, which generally stated consist in decorative plate mounting assembly within the scope of the appended claims.

The invention having thus been described, the following is claimed:

1. A decorative plate and mounting assembly comprising a decorative plate having a front side and a rear side, a panel having a front surface and a rear surface with an opening extending therethrough, the decorative plate being positioned adjacent the front surface of the panel and covering the opening with the front side of the plate facing away from the front surface of the panel, a set of gripping members adjacent the rear side of the plate and having parts engaging the front side of the plate at spaced-apart edge portions thereof, a resilient member connecting the gripping members and urging the gripping members one toward the other and into gripping relationship with the edge portions of the plate, a rigid securing member extending across the opening adjacent the rear surface of the panel, and the rigid securing member also extending between the resilient member and the rear side of the plate and securing the resilient member and the gripping members and the plate to the panel.

2. A decorative plate and mounting assembly comprising a decorative plate having a front side and a rear side, a panel having a front surface and a rear surface with an opening extending therethrough, the decorative plate being positioned adjacent the front surface of the panel and covering the opening with the front side of the plate facing away from the front surface of the panel, a set of gripping members adjacent the rear side of the plate and having parts engaging the front side of the plate at spaced-apart edge portions thereof, an elongate spring connecting the gripping members and urging the gripping members one toward the other and into gripping relationship with the edge portions of the plate, a rigid securing member extending across the opening adjacent the rear surface of the panel, and the rigid securing member also extending between the elongate spring and the rear side of the plate and securing the elongate spring and the gripping members and the plate to the panel, the set of gripping members including a pair of generally U-shaped yoke members, each yoke member having a pair of stems, each stem being provided with a curved finger at the end thereof which engages the front side of the plate.

3. A decorative plate and mounting assembly comprising a decorative plate having a front side and a rear side, a panel having a front surface and a rear surface with an opening extending therethrough, the decorative plate being positioned adjacent the front surface of the panel and covering the opening with the front side of the plate facing away from the front surface of the panel, a set of gripping members adjacent the rear side of the plate and having parts engaging the front side of the plate at spaced-apart edge portions thereof, a resilient member connecting the gripping members and urging the gripping members one toward the other and into gripping relationship with the edge portions of the plate, a pair of rigid elongate securing members extending across the opening adjacent the rear surface of the panel, and the rigid elongate securing members also extending between the resilient member and the rear side of the plate and securing the resilient member and the gripping members and the plate to the panel.

4. A decorative plate and mounting assembly comprising a decorative plate having a front side and a rear side, a panel having a front surface and a rear surface with an opening extending therethrough, the decorative plate being positioned adjacent the front surface of the panel and covering the opening with the front side of the plate facing away from the front surface of the panel, a set of gripping members adjacent the rear side of the plate and having parts engaging the front side of the plate at spaced-apart edge portions thereof, a resilient member connecting the gripping members and urging the gripping members one toward the other and into gripping relationship with the edge portions of the plate, a rigid securing member extending across the opening adjacent the rear surface of the panel, and the rigid securing member also extending between the resilient member and the rear side of the plate and securing the resilient member and the gripping members and the plate to the panel, the gripping members including a pair of yokes positioned at substantially opposed portions of the plate, the yokes having spaced-apart end portions engaging the front side of the plate.

* * * * *